US006994342B2

(12) United States Patent
Ito et al.

(10) Patent No.: US 6,994,342 B2
(45) Date of Patent: Feb. 7, 2006

(54) BANKNOTE HANDLING DEVICE

(75) Inventors: Yukio Ito, Tokyo (JP); Noboru Yamagishi, Tokyo (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 77 days.

(21) Appl. No.: 10/488,917

(22) PCT Filed: Jun. 19, 2002

(86) PCT No.: PCT/JP02/06133

§ 371 (c)(1),
(2), (4) Date: Mar. 5, 2004

(87) PCT Pub. No.: WO03/027969

PCT Pub. Date: Apr. 3, 2003

(65) Prior Publication Data

US 2004/0238318 A1 Dec. 2, 2004

(30) Foreign Application Priority Data

Sep. 19, 2001 (JP) ..... 2001-285075

(51) Int. Cl.
*B65H 29/68* (2006.01)

(52) U.S. Cl. ..... 271/182; 271/180

(58) Field of Classification Search ..... 271/180, 271/181, 182, 177, 209
See application file for complete search history.

(56) References Cited

U.S. PATENT DOCUMENTS

| | | | | |
|---|---|---|---|---|
| 4,789,149 | A * | 12/1988 | Ray et al. | 271/215 |
| 5,549,289 | A * | 8/1996 | Sonnenburg et al. | 271/121 |
| 5,564,691 | A | 10/1996 | Hatamachi et al. | |
| 6,328,303 | B1 * | 12/2001 | Maetani | 271/273 |

FOREIGN PATENT DOCUMENTS

| | | |
|---|---|---|
| JP | 05-310354 | 11/1993 |
| JP | 08-067396 | 3/1996 |
| JP | 2002-216209 | 8/2002 |

* cited by examiner

*Primary Examiner*—Donald P. Walsh
*Assistant Examiner*—Mark J. Beauchaine
(74) *Attorney, Agent, or Firm*—Welsh & Katz, Ltd.

(57) ABSTRACT

A banknote handling device capable of positioning and stopping a banknote at a constant position as accurately as possible without jamming of any banknote. A projection (32) is disposed so as to curve a side of the banknote carried in a slit (9) and the radius of curvature of the curve portion is gradually increased as the banknote (b) is carried toward the downstream side in the slit (9).

5 Claims, 20 Drawing Sheets

BANKNOTE HANDLING DEVICE

TECHNICAL FIELD

The present invention relates to a banknote handling device installed in equipment such as an automatic vending machine that identifies the authenticity of inserted banknotes and stacks and accommodates genuine notes in a stacker, and in particular relates to improvements in a banknote handling device whereby banknotes of different length are stacked and accommodated in the same stacker.

BACKGROUND ART

With the issue of 2000-yen notes in recent years, banknote handling devices have been proposed that are able to accommodate in the same stacker banknotes of different length (for example 1000-yen notes, and 2000 yen notes which are longer than 1000-yen notes).

If banknotes of different length are to be accommodated in this way in the same banknote accommodating unit (stacker), there are the following problems.

These will be described with reference to a conventional banknote handling device 1 shown schematically in FIG. 13.

First of all, when a banknote A of long length is inserted into a banknote slot 2, this banknote A is carried by being gripped between an endless banknote conveyor belt 4 arranged on a banknote carrying path 3 of substantially U-shaped cross section and follower rollers 5 pressing against this belt. Then, if the banknote is identified as genuine by a banknote identification unit 6, carrying thereof is arrested at the time point where the rear edge A1 of this banknote A passes the banknote identification unit 6 and the banknote is temporarily retained (escrowed).

When a product is purchased, the temporarily retained (escrowed) banknote A of long length that has been inserted is accommodated in the stacker 14.

The banknote conveyor belt 4 is then again driven from the condition shown in FIG. 13 so that the banknote A is guided further downstream to the slit 9 of a stacker guide 8 that is arranged within the device body 7 of the banknote handling device 1.

After this, as shown in FIG. 14, when the rear edge A1 of the banknote A leaves the stacker roller 10, which is a final roller that presses against the banknote conveyor belt 4, this banknote A falls downwards of its own weight along the slit 9 until its tip A2 abuts the bottom face 7*a* of the device body 7, where it is stopped.

When the leading end A2 of the banknote A has been stopped in this way by abutment with the bottom face 7*a* of the device body 7, the rear edge A1 of the banknote A comes to rest in a position in which it does not cross the tip 12*a* of a banknote sagging preventing lever 12 that is freely rotatably journalled about a shaft 11 above the stacker roller 10 but whose rotation in the clockwise direction is restrained. It should be noted that the mounting position of the tip 12*a* of this banknote sagging preventing lever 12 is set beforehand in a position engaging the rear edge A1 when a banknote A of long length has fallen downwards and been stopped.

In this way, after the rear edge A1 of the banknote A has been stopped in a position in which it does not pass the tip 12*a* of the banknote sagging preventing lever 12, a lift table 13 as generally known comprising a link mechanism is reciprocated to left and right in the drawing as shown by the arrow F, whereupon the banknote A in the slit 9 of the stacker guide 8 is moved into the stacker 14 as shown in FIG. 15.

The banknote A that has been moved into this stacker 14 is constantly biased toward the stacker guide 8 by a pressure plate 16 biased in the leftwards direction in the drawing by pressing means comprising a coil spring 15.

At this point, the rear edge A1 of the banknote A is in a position engaging the tip 12*a* of the banknote sagging preventing lever 12, so even if the rear edge A1 of the banknote A is moved toward the slit 9 of the stacker guide 8 by swelling due to some cause such as swelling of the other accommodated banknotes accommodated in the stacker 14, this movement is inhibited by the banknote sagging preventing lever 12 that is engaged therewith and so does not reach the slit 9; consequently, there can be no interference between the banknote that is next guided into the slit 9 of the stacker 8 and the rear edge A1 of the banknote A accommodated in the stacker 14, so the banknote that is next to be accommodated moves smoothly into the stacker 14 and is stacked and accommodated therein.

In contrast, if, after a banknote B of shorter length than that of the banknote A described above has been escrowed, this banknote B falls down within the slit 9 of the stacker guide 8 of its own weight as shown in FIG. 16 and the tip B2 of the banknote B is stopped abutting the bottom face 7*a* of the device body 7 instead of being stopped midway and so may assume a position in which the rear edge B1 of the banknote B has passed the tip 12*a* of the banknote sagging preventing lever 12.

If this happens, if the lift table 13 is driven with this rear edge B1 of the banknote B still in a condition in which it has been stopped at a position past the tip 12*a* of the banknote sagging preventing lever 12, when the banknote B is accommodated in the stacker 14 as in FIG. 17, the rear edge B1 of the banknote B may project due to swelling within the slit 9 of the stacker guide 8 as in FIG. 18, resulting from some cause such as swelling of the other accommodated banknotes accommodated in the stacker 14; this may result in interference (collision) of the rear edge B1 of the banknote B with the next banknote to be guided into the slit 9, with a risk of causing the banknotes to jam at this point.

Conventionally, therefore, brake means was provided to inhibit the fall of banknotes to the lift table 13 in the vicinity of the stacker guide 8 so as to stop a banknote B of short length as described above in a position where it has not yet passed beyond the tip 12*a* of the banknote sagging preventing lever 12.

FIG. 19 is a schematic cross-sectional view of a banknote handling device 21 wherein brake means 20 is provided as described above; parts that are identical with those of FIGS. 14 to 18 are shown with the same reference symbols.

As shown in FIG. 20, which is an enlarged perspective view of its main portion, this brake means 20 comprises a projection 22 that projects at the side of the lift table 13. Such a projection 22 is also provided in a symmetrical position along the width direction of the lift table 13.

This projection 22 comprises an inclined section 22*a* that guides the banknote and a parallel face 22*b* parallel with the slit 9 of the stacker guide 8, this parallel face 22*b* projecting in a direction such as to block the width of the slit 9.

With such brake means 20, when for example a banknote B falls down along the slit 9 of the stacker guide 8 as shown by the arrow G as in FIG. 21, first of all its tip B2 is guided along the inclined face 22*a* of the projection 22 toward the parallel face 22*b*.

Thus, when the tip B2 of a banknote B is guided toward the parallel face 22*b*, as shown in FIG. 22, the side B3 of the banknote B is simultaneously curved by the parallel face 22*b* so that the side B3 of the banknote B and the upper edge 9*a* of the slit 9 are in pressure contact due to the resilient force of the banknote produced by the curved section B4, with the result that frictional force acting as brake force F acts in this interval.

By the action of the brake force F produced by the frictional force of this projection 22, when the banknote B falls down in the direction of the arrow G and is carried, the tip B2 of this banknote B does not reach the bottom face 7*a* of the device body 7 shown in FIG. 23, so the banknote B in question is stopped midway and the rear edge B1 of the banknote B is therefore stopped in a position that does not pass the tip 12*a* of the banknote sagging preventing lever 12.

Consequently, the rear edge B1 of the banknote B stops in a position in which it has not passed the tip 12*a* of the banknote sagging preventing lever 12, so there is no possibility of the rear edge B1 of the banknote B projecting as shown in FIG. 18 due to swelling in the slit 9 of the stacker guide 8 due to some cause such as the swelling of the other accommodated banknotes accommodated in the stacker 14, so interference (collision) of the rear edge B1 of the banknote B with the next banknote B guided within the slit 9 does not occur and there is no risk of the banknotes becoming jammed at this point.

However, since, as shown in FIG. 20, the brake means 20 of the conventional banknote handling device 21 described above is constituted by a projection 22 comprising a parallel face 22*b* and an inclined part 22*a* projecting at the side of the lift table 13 and, as shown in FIG. 22, the radius of curvature of the curved part B4 of the banknote is unchanged even if the tip of the banknote is carried downstream of the parallel face 22*b*, the construction is one in which the resilient force applied to the upper edge 9*a* of the slit 9 by this curved part B4 does not change and the frictional contact surface area of the banknote side face B3 and the upper edge 9*a* of the slit 9 gradually increases as the banknote as a whole moves downstream of the slit 9.

The relationship between the distance moved by the banknote tip B2 along the parallel face 22*b* and the brake force F applied to the banknote tip B2 is therefore as shown graphically in FIG. 24. The brake force F applied to the banknote tip B2 therefore remains large without changing, even if the banknote tip B2 moves downstream of the parallel face 22*b*; the result of this is therefore that there is an abrupt increase in the braking force acting on the banknote as a whole as the banknote moves downstream of the slit 9.

Consequently, when the tip A2 of a banknote A of long length is guided downstream of the slit 9, being guided by the parallel face 22*b* of this projection 22, an abruptly increasing brake force acts on the banknote as a whole, causing the fall (movement) of the banknote A to be stopped midway and furthermore giving rise to the risk, as shown in FIG. 25, of a paper jam D occurring within the slit 9 of the stacker guide 8 due to the carrying force of the stacker roller 10, which is the last roller pressing on the banknote conveyor belt 4. This tendency is even more marked when guiding banknotes A of long length that are formed with creases.

Also, since the projection 22 described above is moved to left and right by the link mechanism and therefore projects at the side of the lift table 13, where there may be large errors of positional location, there is a risk of generation of errors of positional location due to large differences in relative position of the projection 22 with respect to the slit 9 of the stacker guide 8 fixed to the device body 7 occurring with each back and forth movement of the lift table 13. If this results in the relative position of the lift table 13 and the slit 9 becoming different, there may be a large change in the radius of curvature of the curved part of the banknote produced by the projection 22, resulting in large variation of the frictional force acting between the side of the banknote and the upper edge 9*a* of the slit 9; there is therefore a risk that it may not be possible to stop the banknote always in a fixed position irrespective of banknote length, because of changes in the brake force on the banknote produced by the projection 22.

In view of the above, an object of the present invention is to provide a banknote handling device in which jamming of banknotes cannot occur and which is capable of locating a banknote in position and stopping the banknote as far as possible in a fixed position.

DISCLOSURE OF THE INVENTION

In order to solve the problems described above, according to the present invention, in a banknote handling device that identifies the authenticity of inserted banknotes of a plurality of types of different length, guides inserted banknotes of a plurality of types of different length that are considered to be genuine into a slit of a stacker guide, and then accommodates the banknotes in the same stacker, brake means is provided comprising a projection whereby a side of the banknote carried in the slit is curved and radius of curvature of the curved portion is caused to increase as the banknote is carried toward a downstream side of the slit.

DESCRIPTION OF THE PREFERRED EMBODIMENTS

Embodiment of a banknote handling device according to the present invention is described in detail below.

Figure 1:
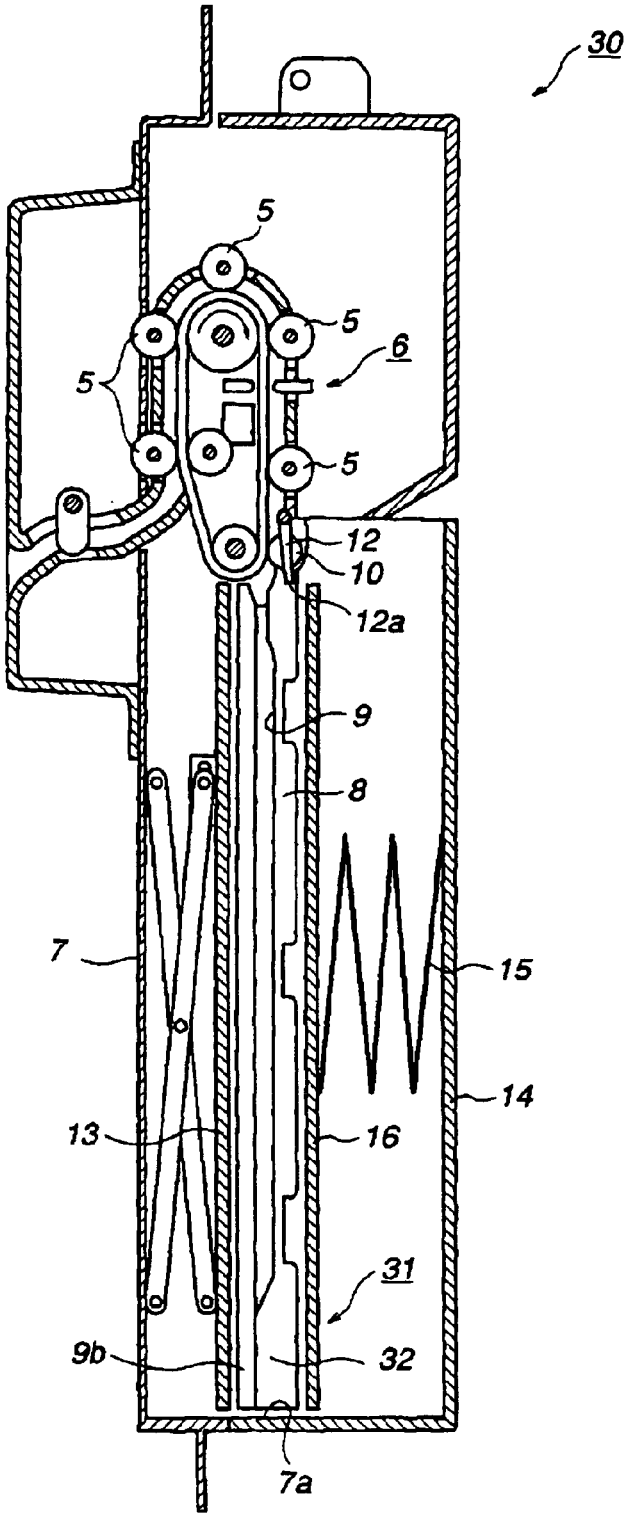
FIG. 1 is a schematic cross-sectional view of a banknote handling device according to the present invention.

FIG. 1 is a schematic cross-sectional view showing a banknote handling device 30 according to the present invention; parts that are the same as in FIG. 13 to FIG. 25 are shown with the same reference symbols.

With this banknote handling device 30, brake means 31 is provided that prevents a banknote from dropping at the downstream end of the stacker guide 8 in order to ensure that banknotes of short length are stopped in a position in which they have not passed the tip 12*a* of the banknote sagging preventing lever 12.

Figure 2:
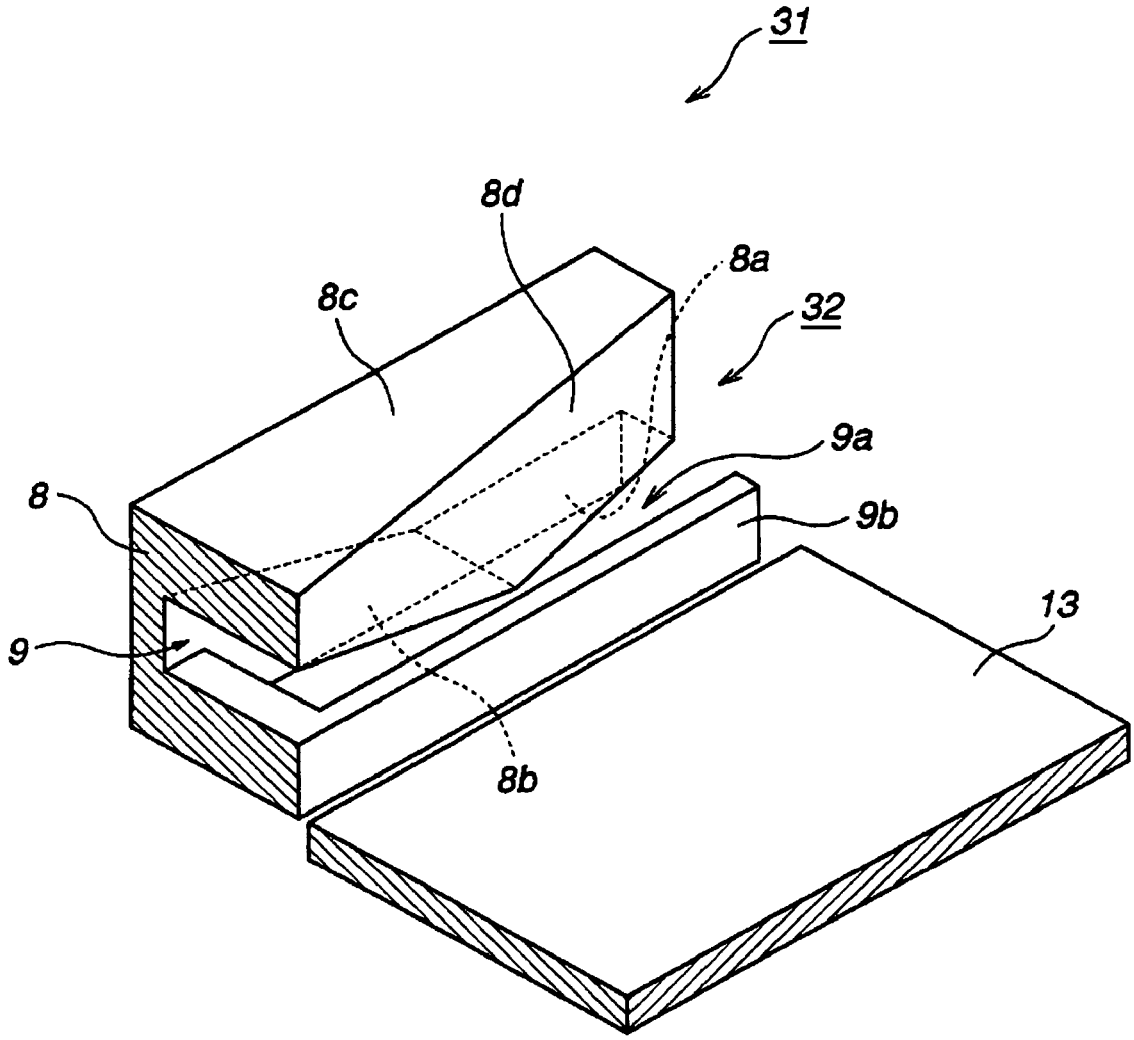
FIG. 2 is an enlarged perspective view of a projection.

As shown in FIG. 2, which is an enlarged perspective view of its main portion, this brake means 31 is constituted by projections 32 that are respectively formed on a pair of stacker guides 8 arranged along both ends of the banknote in the width direction. The projection 32 formed on the other stacker guide 8 is not shown in the drawing.

As shown in FIG. 2, this projection 32 comprises a parallel face 8*a* that is parallel with respect to the direction of advance of the slit 9 and that projects toward the interior of a recess 9*a* formed in the bottom face, constituting a guide face on one side, of the slit 9, and an inclined face 8*b* inclined toward this parallel face 8*a*. Also, this projection 32, seen from the upper face 8*c* of FIG. 2, is formed by an inclined side face 8*d* that is inclined such that its right side face (on the side of the lift table 13) gradually separates from the wall face 9*b* formed with the recess 9*a* toward the downstream side of the slit 9.

Figure 3:
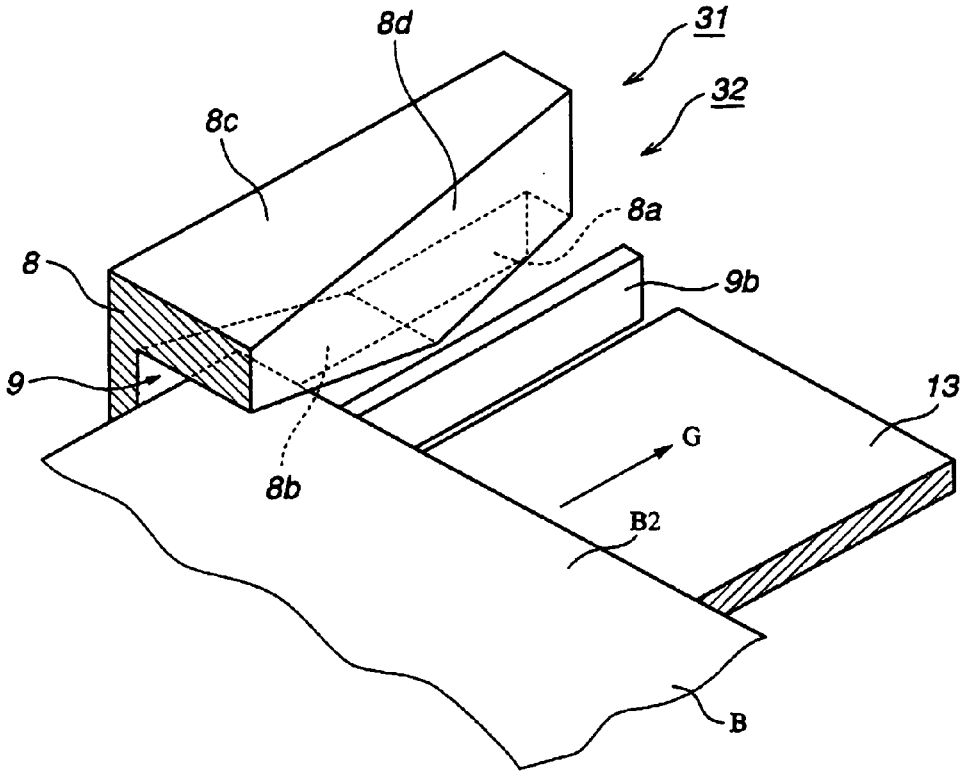
FIG. 3 is a view showing the action of the projection.

With such brake means 31, as shown in FIG. 3, when for example a banknote B drops along the slit 9 of the stacker guide 8 as shown by the arrow G, first of all its tip B2 is guided to the parallel face 8*a* along the inclined face 8*b* of the projection 32.

Figure 4:
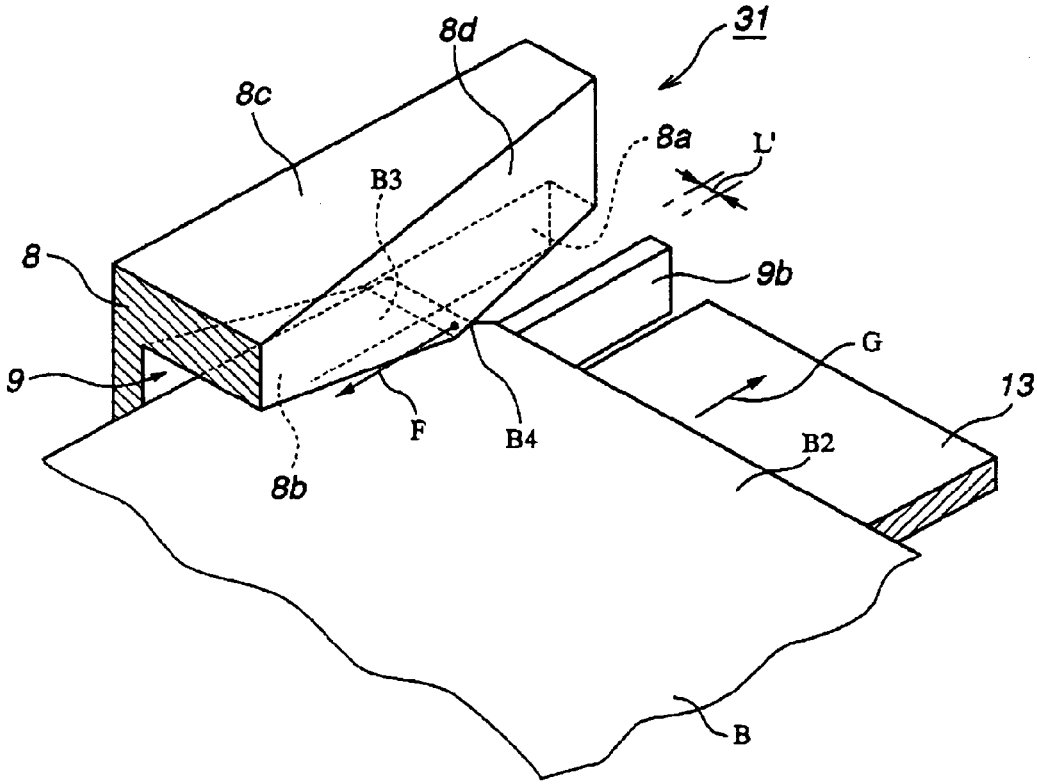
FIG. 4 is a view showing the action of the projection.

When the tip B2 of a banknote B is guided in this way to the parallel face 8*a* along the inclined face 8*b* of the projection 32, as shown in FIG. 4, the side B3 of the banknote B is sandwiched and curved between the parallel face 8*a* of the projection 32 and the wall face 9*b* of the slit 9 and the side face B3 of the banknote B and the parallel face 8*a* are pressed into contact by means of the resilient force of the banknote produced by this curved face B4, with the result that frictional force constituting brake force F acts therebetween in the direction of advance of the banknote B.

Figure 5:
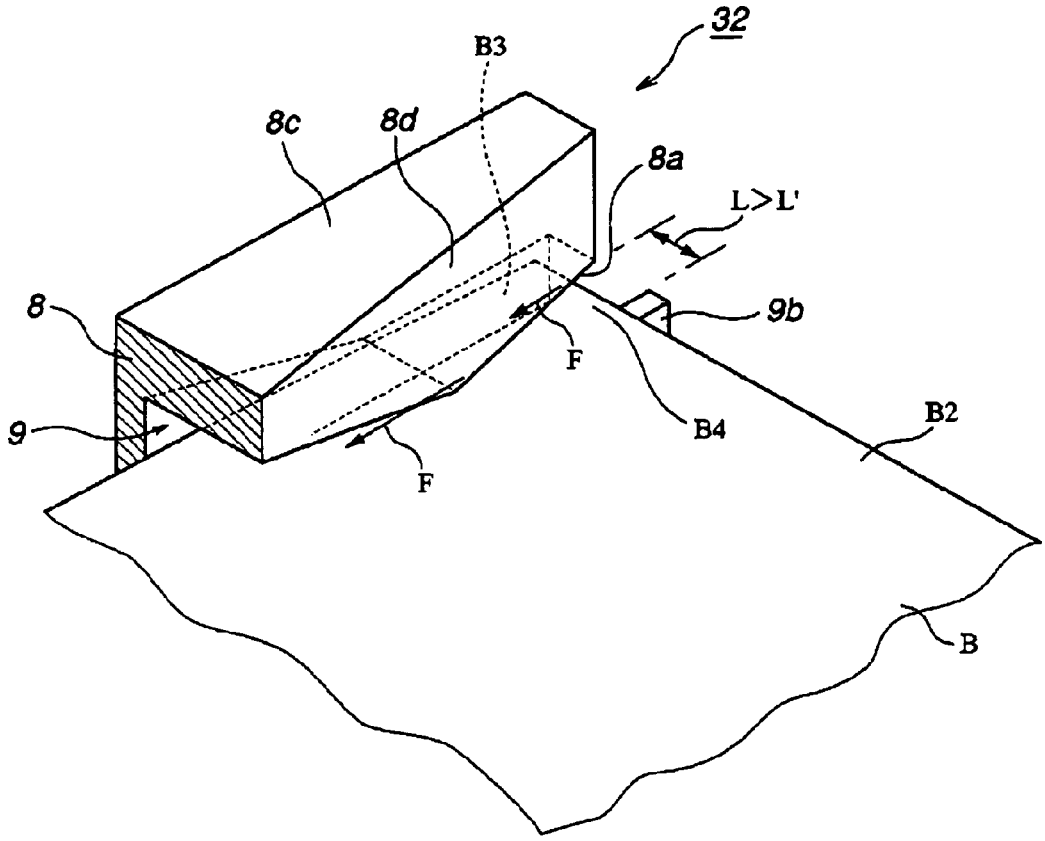
FIG. 5 is a view showing the action of the projection.

When the banknote B is carried further downstream of the slit 9 from the position of the banknote B shown in this FIG. 4, as shown in FIG. 5, as the side B3 of the banknote tip B2 is carried further downstream along the parallel face 8*a* of the projection 32, the distance L between the parallel face 8*a* of the projection 32 where the side B3 of the banknote tip B2 makes contact and the wall face 9*b* of the slit 9 gradually increases during this process (L>L') compared to the distance L', shown in FIG. 4 by the inclined side face 8*d*, between the parallel face 8*a* of the projection 32 where the side B3 of the banknote tip B2 initially makes contact and the wall face 9*b* of the slit 9.

Consequently, as shown in FIG. 5, the radius of curvature of the curved face B4 of the banknote side B3 that is curved by being sandwiched between the parallel face 8*a* of the projection 32 and the wall face 9*b* of the slit 9 gradually increases as the banknote is carried further downstream of the slit 9.

Consequently, as the banknote B is carried further downstream of the slit 9, the resilient force with which the side B3 of the banknote presses against the parallel face 8*a* of the projection 32 gradually diminishes and, as a result, as the banknote is carried further downstream of the slit 9, the frictional force, constituting the brake force F, acting between the side B3 of the banknote tip B2 and the parallel face 8*a* of the projection 32 that makes contact therewith also gradually diminishes.

Figure 6:
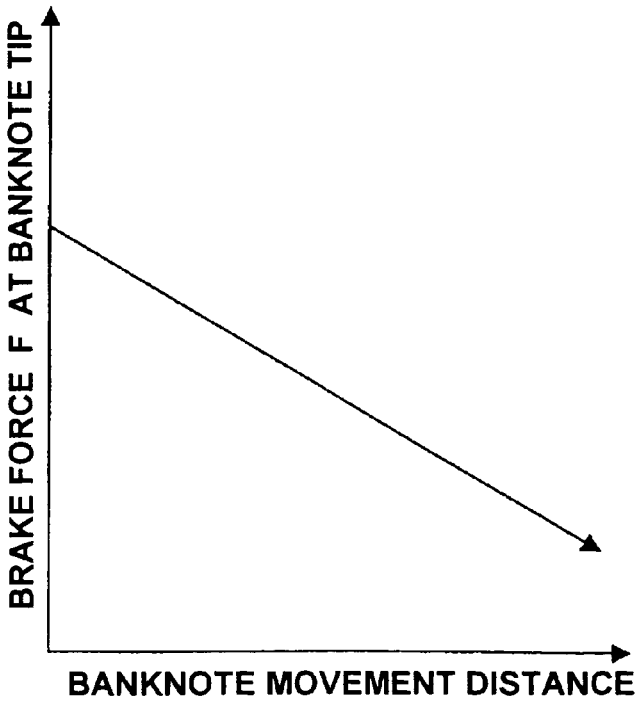
FIG. 6 is a view showing the change of brake force produced by the projection.

The relationship between the distance moved by the banknote tip B2 along the parallel face 8*a* and the brake force F that is supplied to the banknote tip B2 is shown graphically in FIG. 6. As the banknote tip B2 moves downstream of the parallel face 22*b*, the brake force F that is applied to the banknote tip B2 abruptly decreases, with the result that even though the banknote B is moving downstream of the slit 9, the brake force that is applied to the entire banknote B assumes a practically fixed magnitude instead of abruptly increasing.

Figure 7:
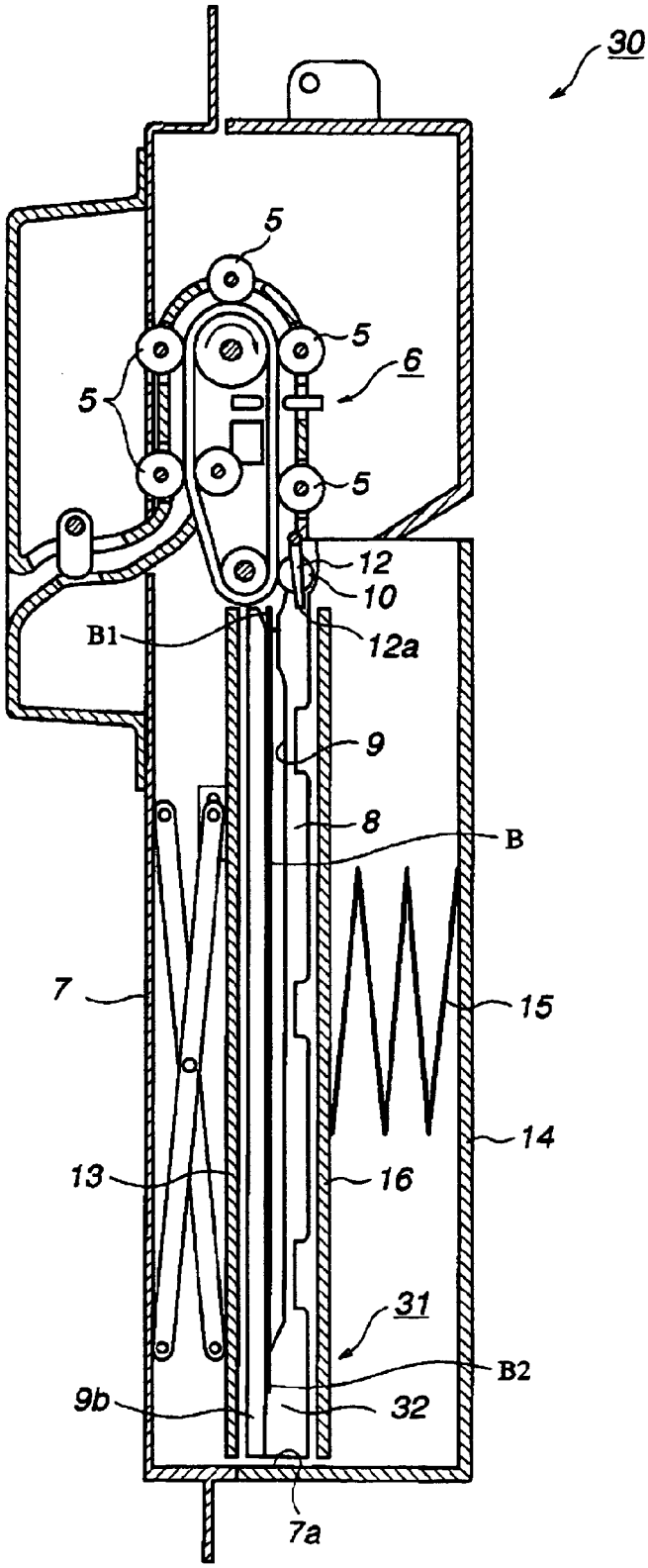
FIG. 7 is a view showing the action of a banknote handling device according to the present invention.

Consequently, as shown in FIG. 7, when the tip B2 of a banknote B of short length falls of its own accord so that the tip B2 reaches the parallel face 8*a* (FIG. 2) of the projection 32, its speed of falling is abruptly diminished by the initially acting large brake force F. The tip B2 is thereupon stopped midway without reaching the bottom face 7*a* of the device body 7 and the rear edge B1 of the banknote B is therefore stopped in a position where it has not passed the tip 12*a* of the banknote sagging preventing lever 12.

Figure 8:
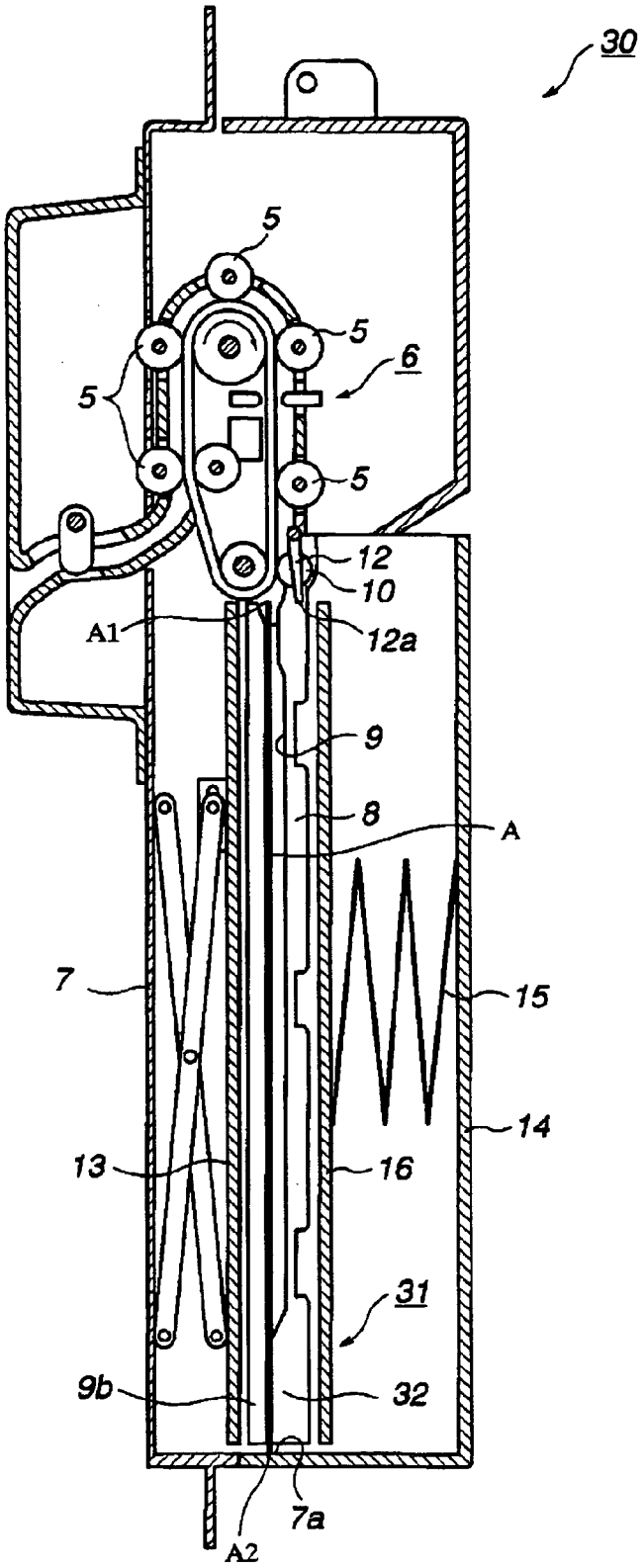
FIG. 8 is a view showing the action of a banknote handling device according to the present invention.

In contrast, when the tip A2 of a longer banknote A falls of its own accord, as shown in FIG. 8, first of all the tip A2 reaches the parallel face 8*a* (FIG. 2) of the projection 32 and is thereupon initially subjected to a comparatively large brake force F. However, as this tip A2 moves further downstream of the parallel face 8*a*, this tip A2 is no longer subjected to a large brake force F but instead the brake force diminishes (see the graph of FIG. 6), so the tip A2 of this banknote A advances smoothly downstream of the slit 9 and there is no possibility of a banknote jam occurring by jamming thereof in this slit 9. Consequently, the banknote A of long length reaches the bottom face 7*a* of the device body 7 after passing the projection 32 of the brake means 31 in smooth fashion as shown in FIG. 8 and is stopped at this point.

Thus, when the tip A2 of the banknote A is stopped by abutment with the bottom face 7*a* of the device body 7, the rear edge A1 of the banknote A stops in a position in which it has not passed the tip 12*a* of the banknote sagging preventing lever 12.

It should be noted that, since the projection 32 of the brake means 31 described above is formed on the stack guide 8 that is fixed to the device body 7, no relative positioning error of the projection 32 with respect to the slit 9 occurs, so there can be no change of the brake force due to such relative positioning error of the projection 32 with respect to the slit 9. The brake force that acts on the banknote is therefore stable and the banknotes can always be in a fixed position irrespective of banknote length.

It should be noted that, although, in this embodiment, in FIG. 2, the projection 32 was formed on the side of the stacker guide 8 positioned at the top in the Figures, the present invention is not restricted to this embodiment and the projection 32 could be formed on the side of the stacker guide 8 at the bottom in the Figures.

If this is done, the wall face 9*b* of the slit 9 will of course be formed on the side of the stacker guide 8 positioned at the top of the Figure.

Figure 9:
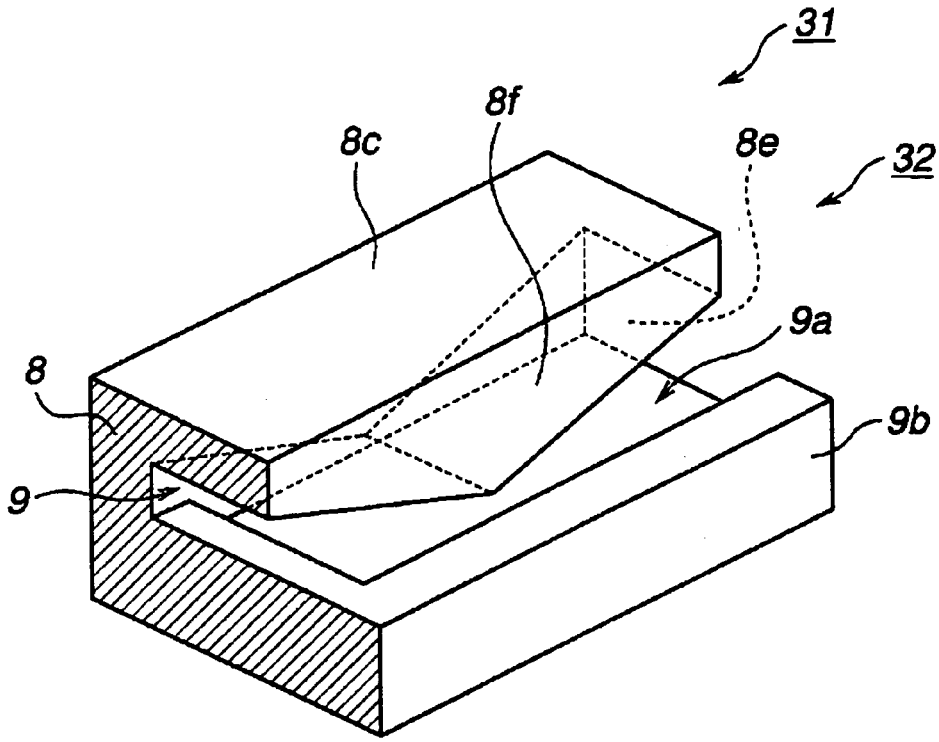
FIG. 9 is a schematic perspective view showing another embodiment of the projection.

It should be noted that, since the projection 32 described above may be arranged to curve the side of the banknote that is being carried in the slit 9 in such a way that the radius of curvature of this curved portion becomes larger as the banknote is carried further downstream of the slit 9, the shape of this projection 32 is not restricted to that of the above embodiment and could be formed, as shown in FIG. 9, in which parts which are the same as in the case of FIG. 2 are shown with the same reference symbols, by means of an inclined face 8*e* that is erected in a direction such as to move further away from the recess 9*a* in the direction of advance of the slit 9 and a side face 8*f* parallel with the wall face 9*b* where the right face thereof forms the recess 9*a* seen from the upper face 8*c*, projecting toward the interior of the recess 9*a* formed in the bottom face constituting one of the guide faces of the slit 9. In this case also, the inclined face 8*e* with respect to the wall face 9*b* is erected in a direction such as to move further away from the recess 9*a* in the direction of advance of the slit 9. The side of a banknote that is guided therebetween is therefore curved and the radius of curvature of this curved portion becomes larger as the banknote is carried further downstream of the slit 9.

Figure 10:
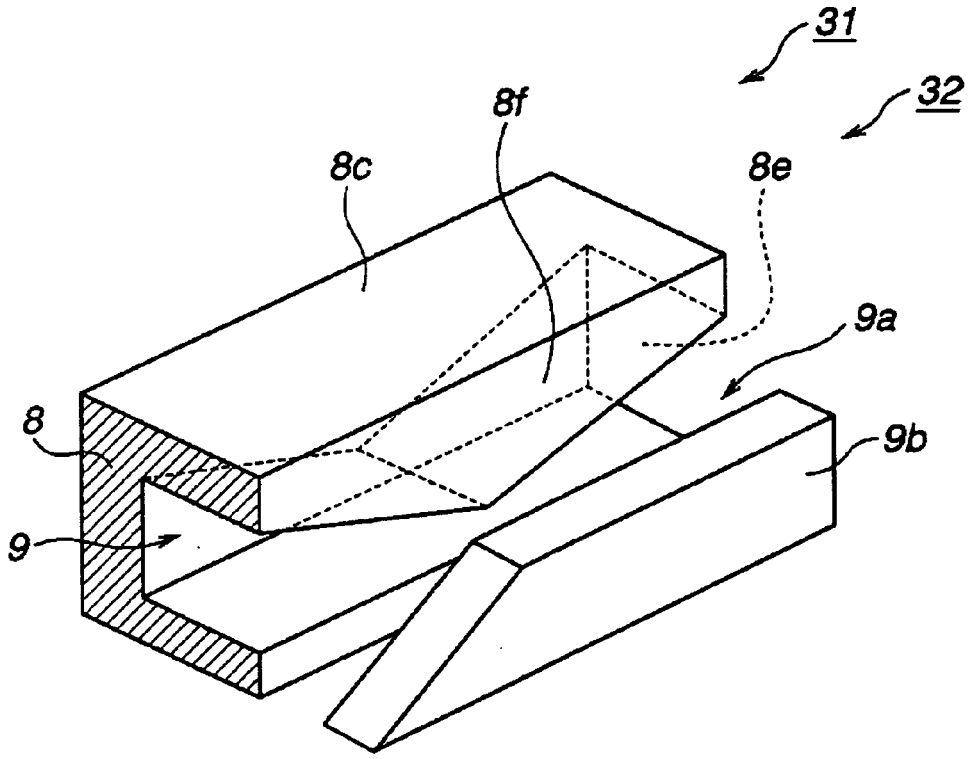
FIG. 10 is a schematic perspective view showing another embodiment of the projection.

It should be noted that, although in the case of the projection 32 of FIG. 9 the wall face 9*b* was formed integrally with the stacker guide 8, it would be possible to form the wall face 9*b* separately from the device body 7 in the vicinity of the stacker guide 8 as shown in FIG. 10, in which parts which are the same as in the case of FIG. 9 are shown with the same reference symbols, or to form this wall face 9*b* on the lift table 13 shown in FIG. 2.

Figure 11:
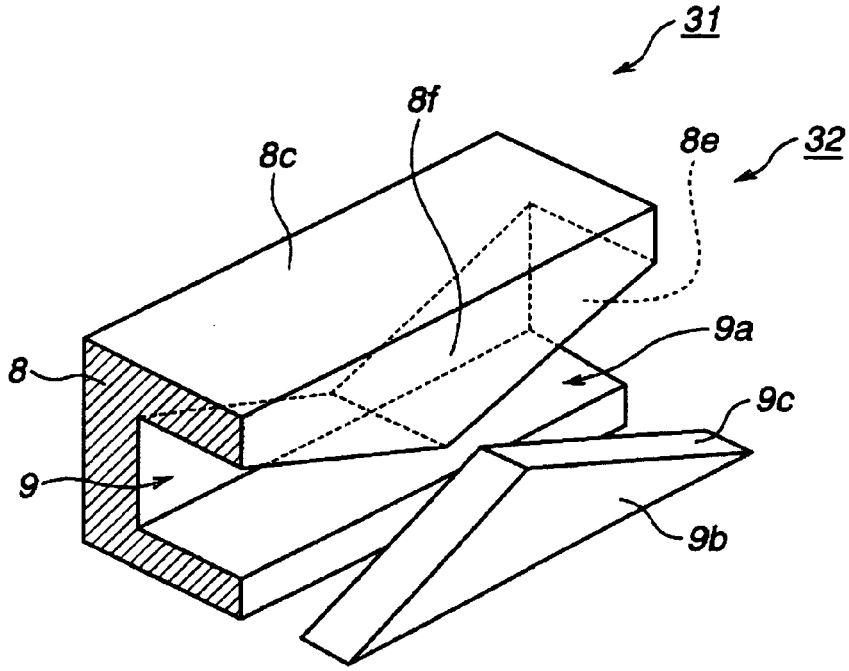
FIG. 11 is a schematic perspective view showing another embodiment of the projection.

Furthermore, although, in the above embodiment, the upper face of the wall face 9*b* was formed parallel with the slit 9, it would be possible, as in FIG. 11, in which parts that are the same as in the case of FIG. 10 are shown with the same reference symbols, to make the portion of the upper face of the wall face 9*b* in the downstream direction an inclined face 9*c* descending in a direction such as to depart further from the inclined face 8*e* in the direction of advance of the slit 9.

This inclined face 9*c* could also be formed separately from the device body 7 in the vicinity of the stacker guide 8 and this wall face 9*b* could be formed on the lift table 13 shown in FIG. 2.

Figure 12:
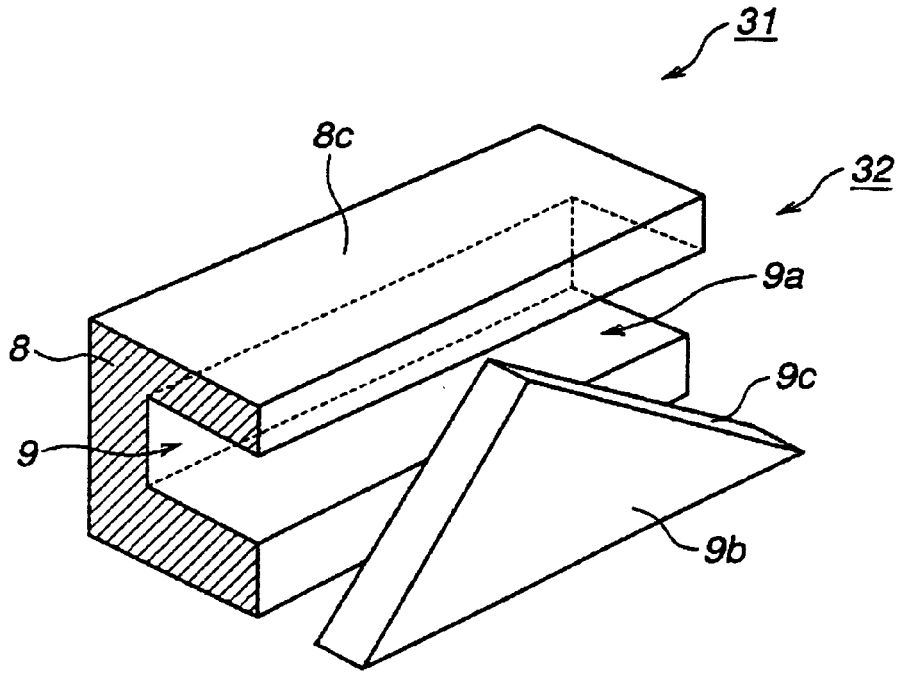
FIG. 12 is a schematic perspective view showing another embodiment of the projection.
Figure 13:
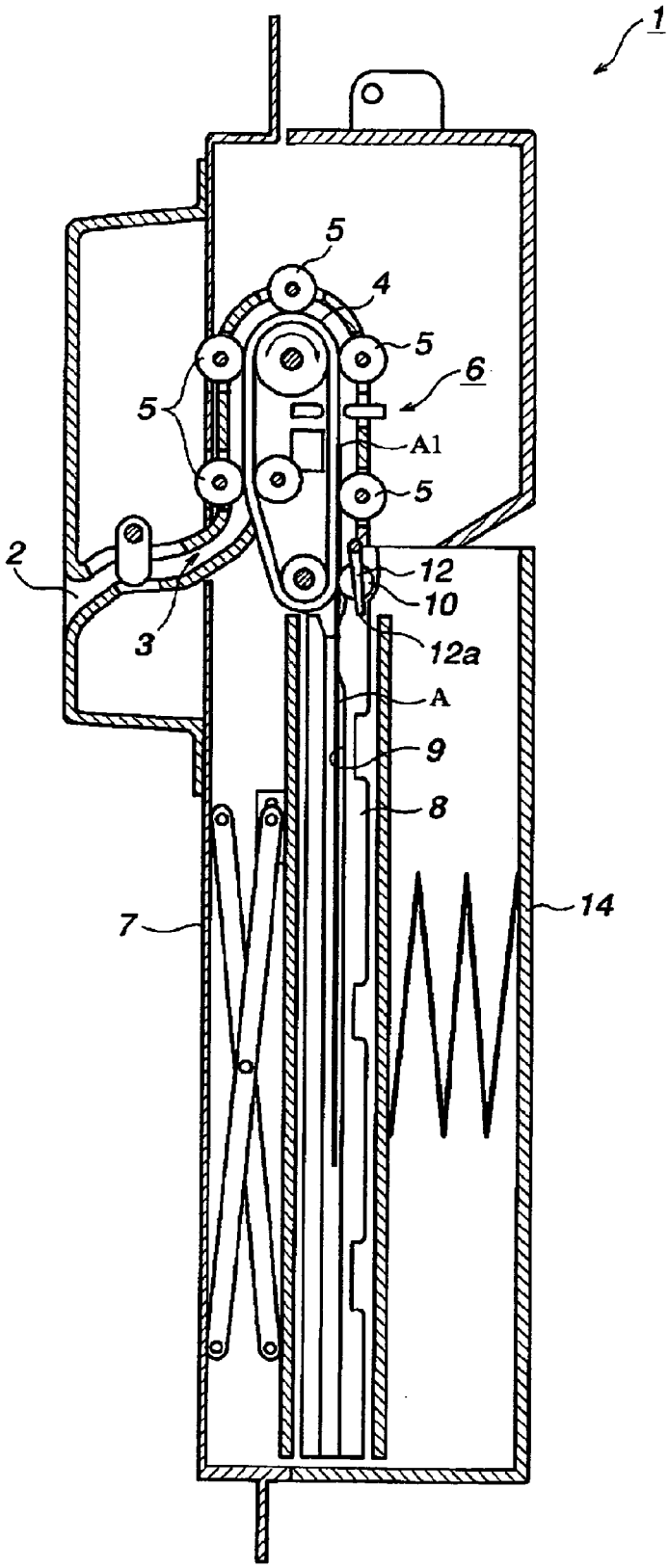
FIG. 13 (PRIOR ART)
FIG. 13 is a schematic cross-sectional view showing a conventional banknote handling device.
Figure 14:
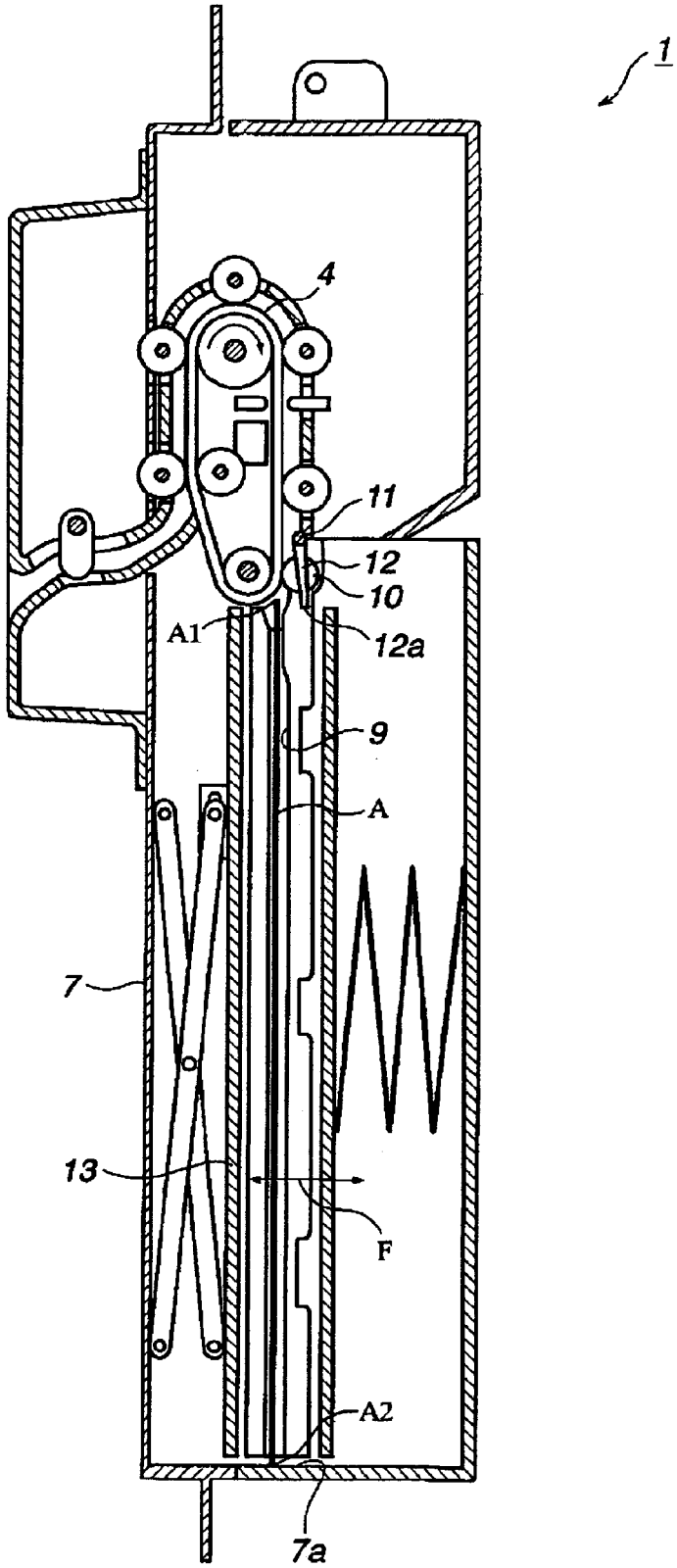
FIG. 14 (PRIOR ART)
FIG. 14 is a view showing the action of the conventional banknote handling device.
Figure 15:
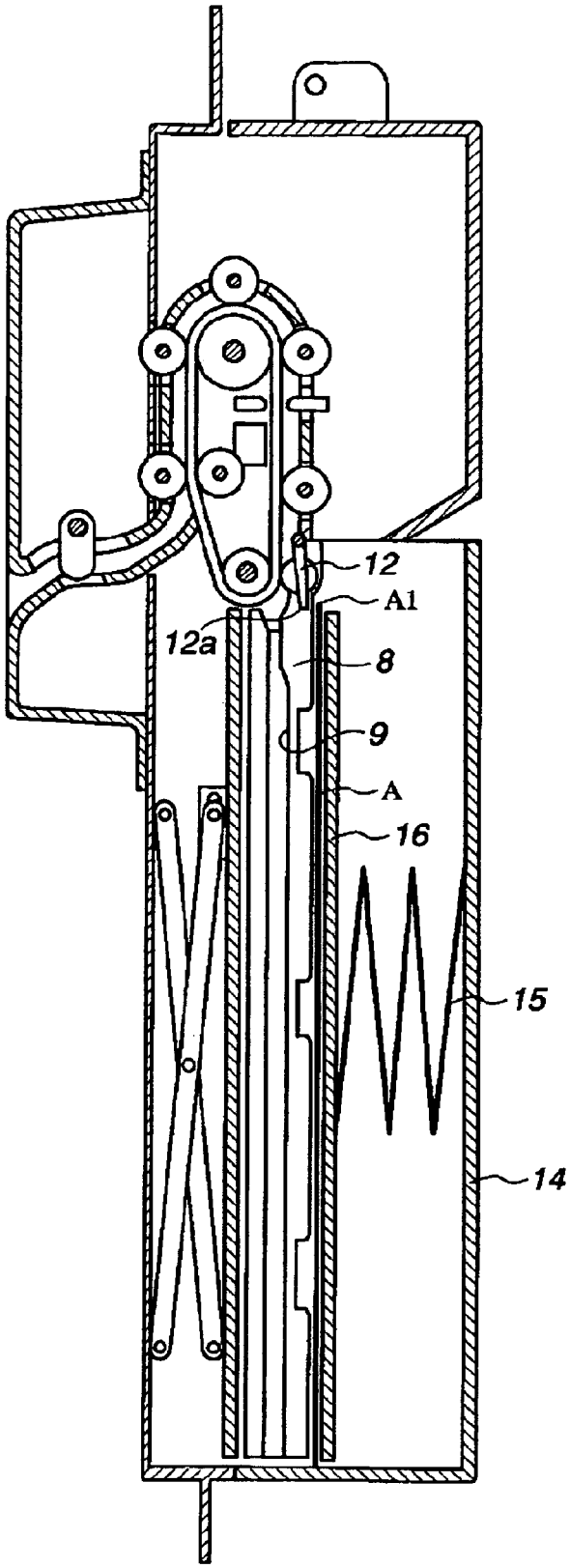
FIG. 15 (PRIOR ART)
FIG. 15 is a view showing the action of the conventional banknote handling device.
Figure 16:
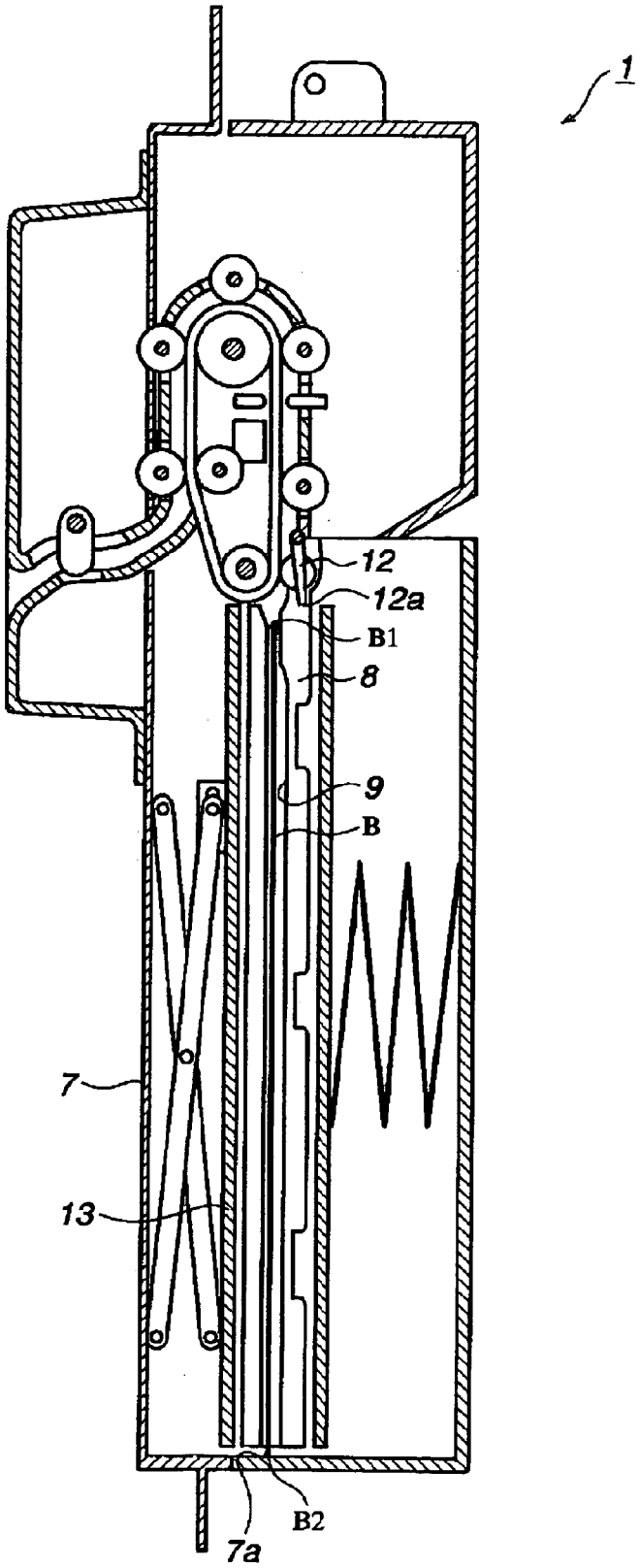
FIG. 16 (PRIOR ART)
FIG. 16 is a view showing the action of the conventional banknote handling device.
Figure 17:
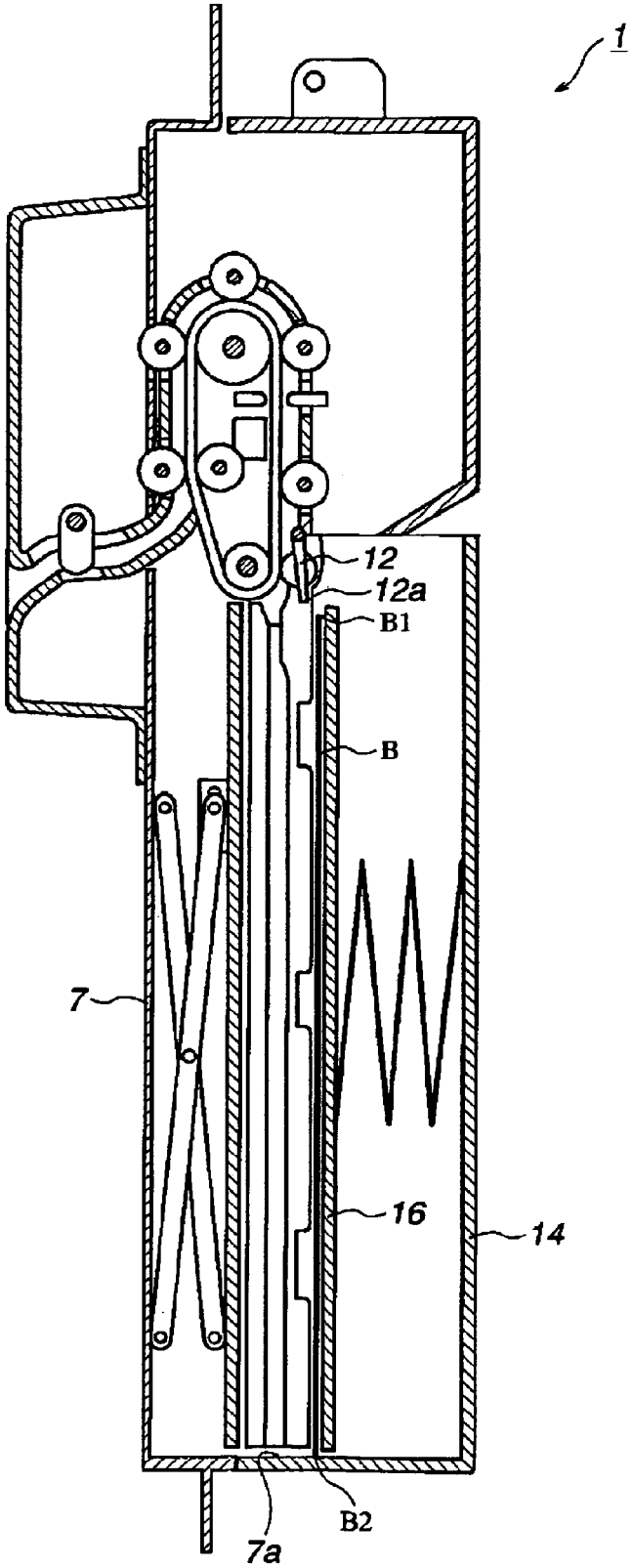
FIG. 17 (PRIOR ART)
FIG. 17 is a view showing the action of the conventional banknote handling device.
Figure 18:
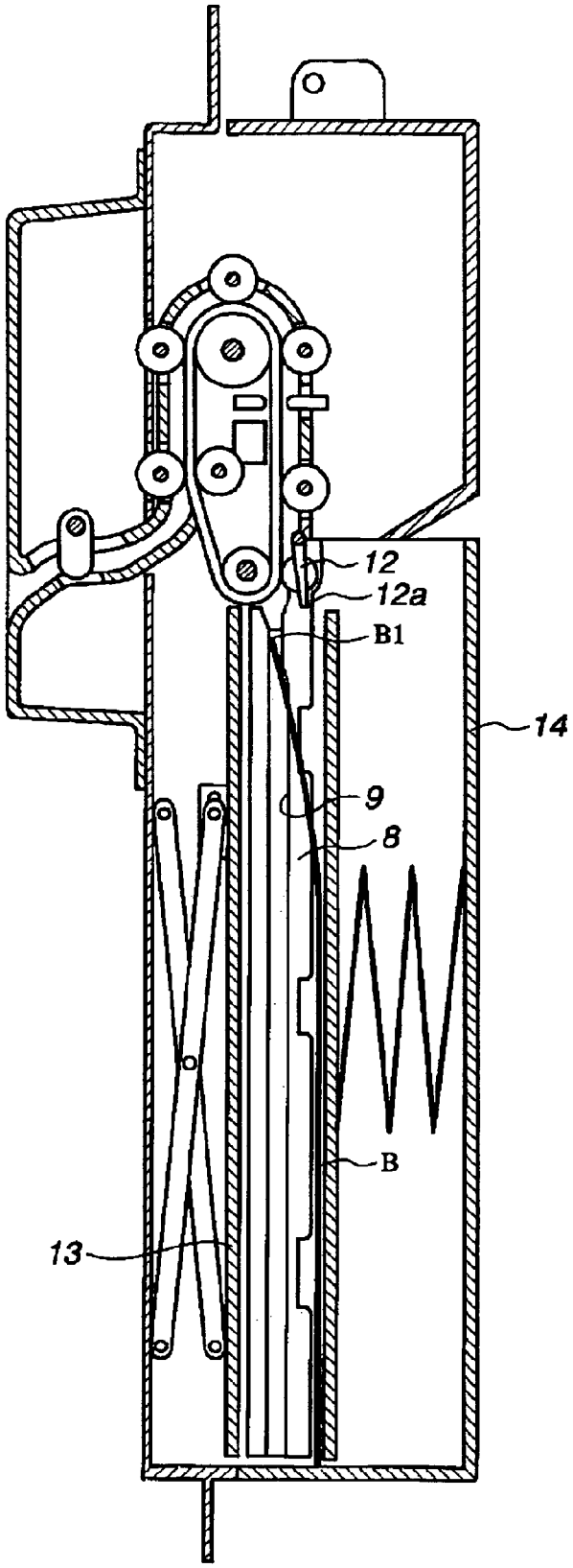
FIG. 18 (PRIOR ART)
FIG. 18 is a view showing the action of the conventional banknote handling device.
Figure 19:
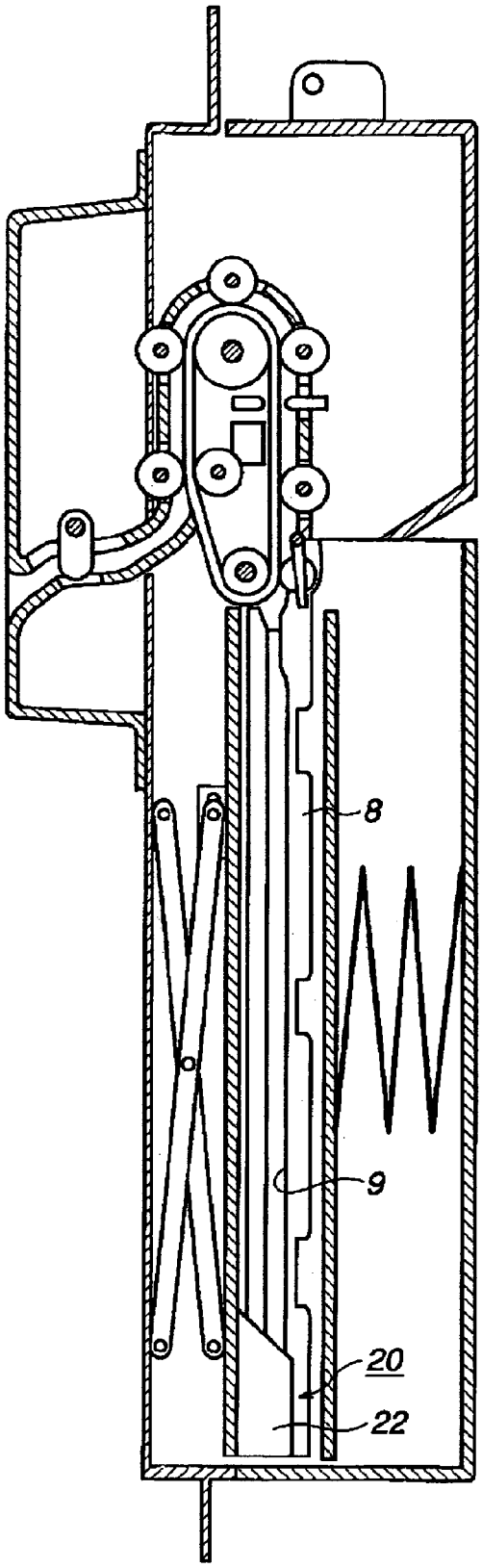
FIG. 19 (PRIOR ART)
FIG. 19 is a schematic cross-sectional view showing another conventional banknote handling device.
Figure 20:
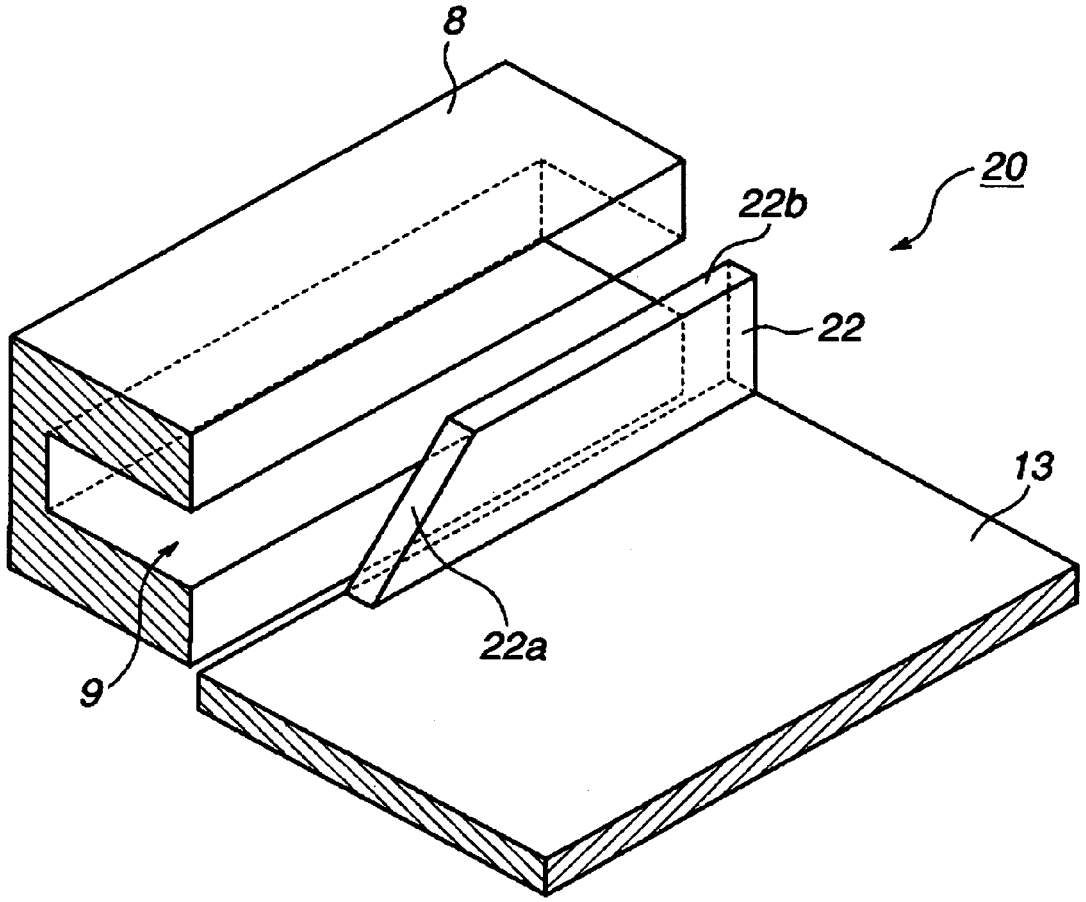
FIG. 20 (PRIOR ART)
FIG. 20 is an enlarged perspective view of a conventional projection.
Figure 21:
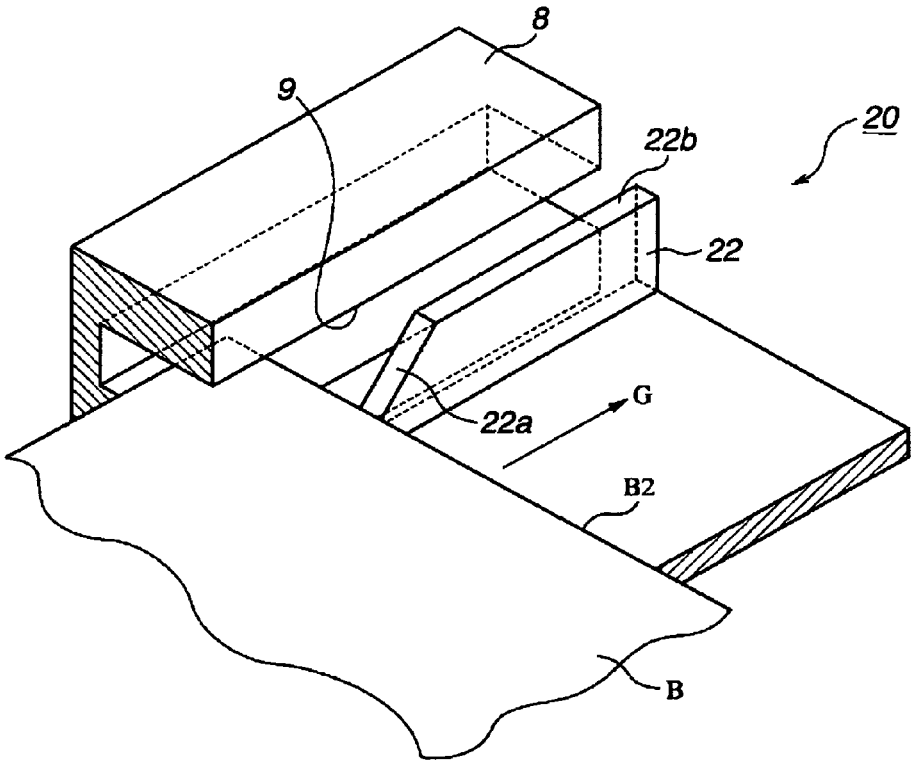
FIG. 21 (PRIOR ART)
FIG. 21 is a view showing the action of the conventional projection.
Figure 22:
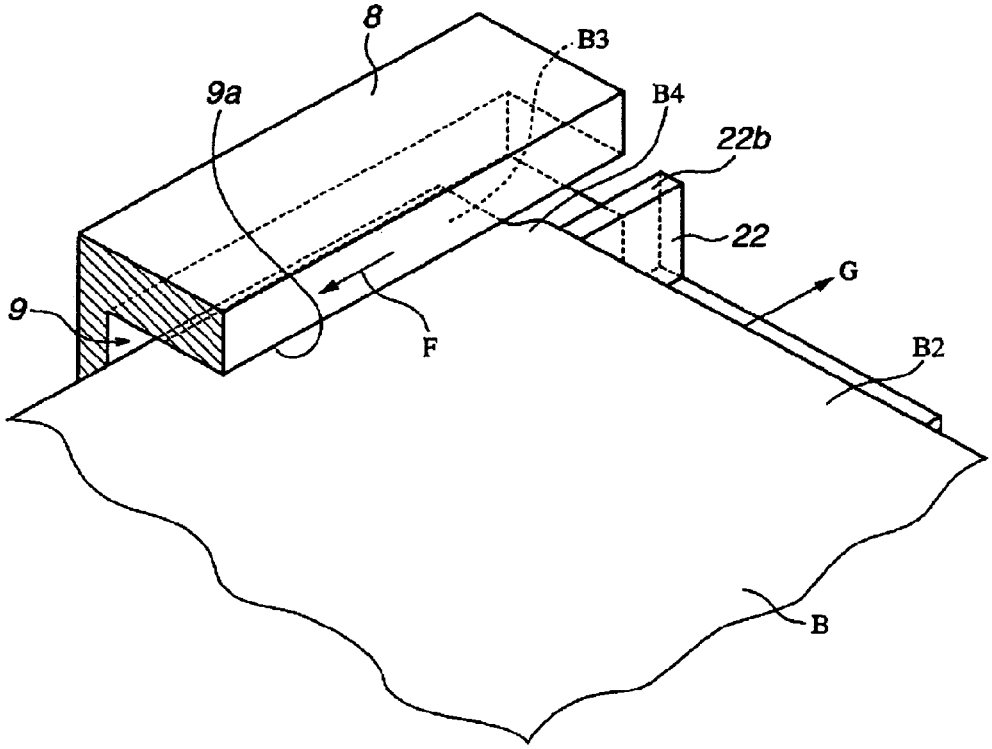
FIG. 22 (PRIOR ART)
FIG. 22 is a view showing the action of the conventional projection.
Figure 23:
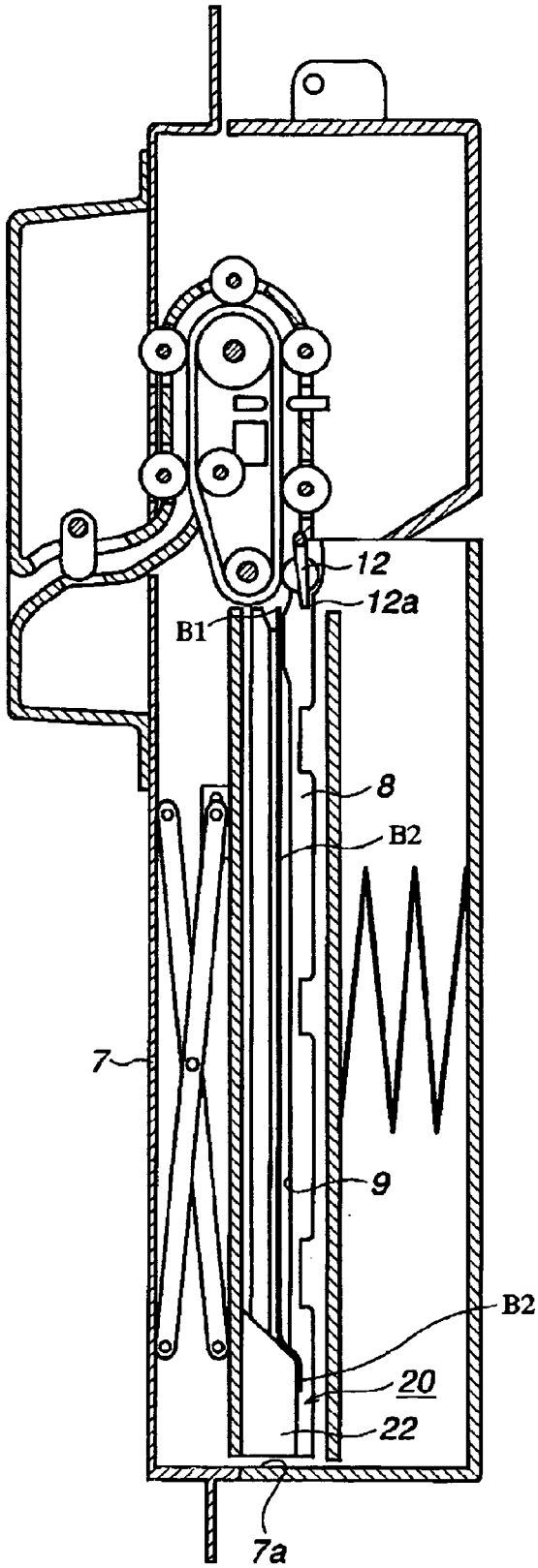
FIG. 23 (PRIOR ART)
FIG. 23 is a view showing the action of another conventional banknote handling device.
Figure 24:
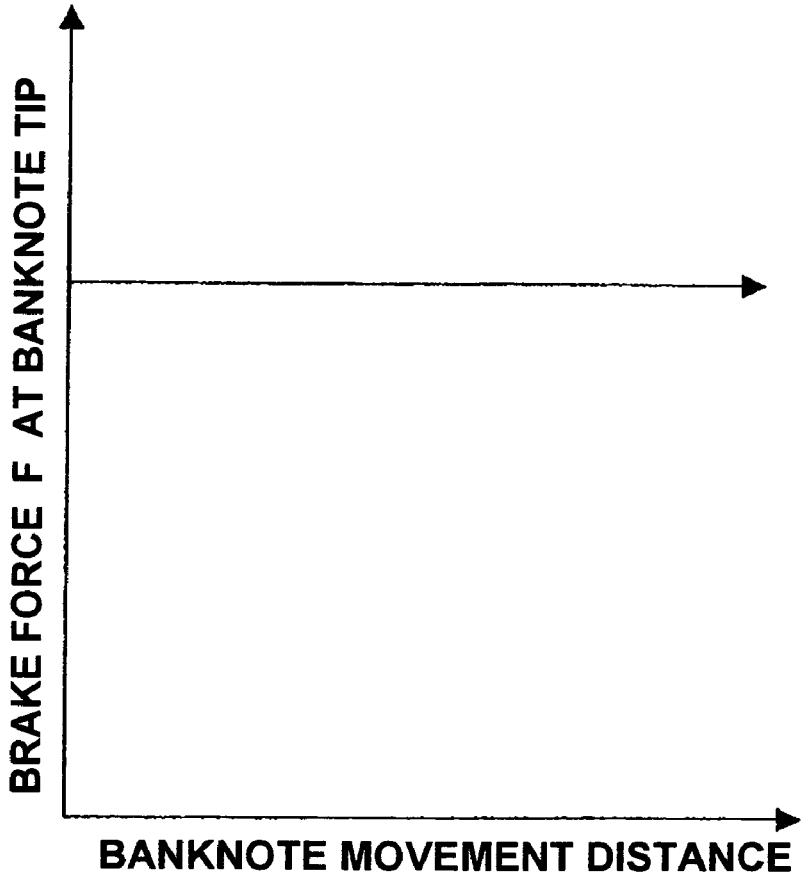
FIG. 24 (PRIOR ART)
FIG. 24 is a view showing the action of another conventional banknote handling device.
Figure 25:
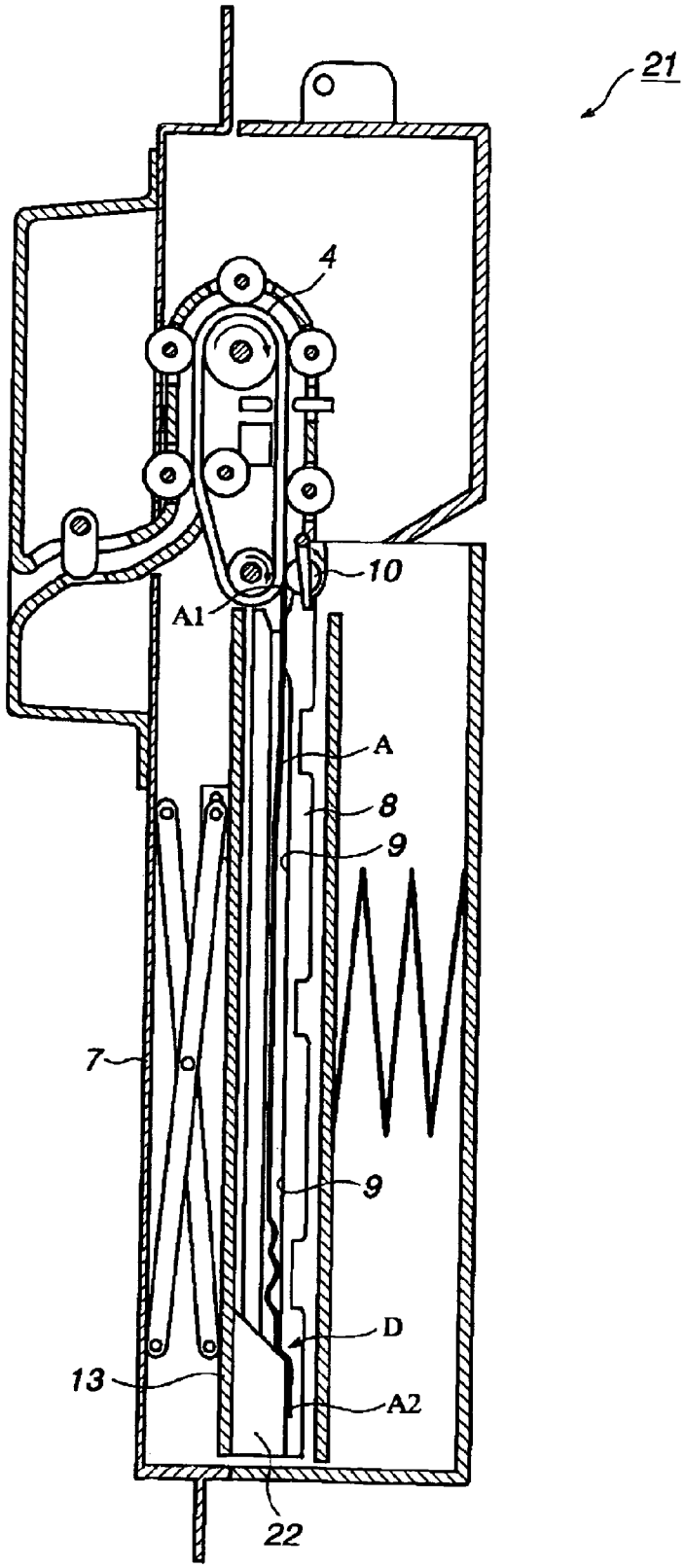
FIG. 25 (PRIOR ART)
FIG. 25 is a view showing the action of another conventional banknote handling device.

Furthermore, although, in the embodiment described above, the inclined face 8*e* was formed on the projection 32, the present invention is not restricted to this embodiment and it would be possible, as in FIG. 12, in which parts that are the same as in the case of FIG. 11 are shown with the same reference symbols, to form the slit 9 itself with parallel upper and lower faces and to constitute a portion in the downstream direction of the upper face of the wall face 9*b* as an inclined face 9*c* descending in a direction such as to depart further therefrom in the direction of advance of the slit 9. It should be noted that this inclined face 9*c* also could be formed separately from the device body 7 in the vicinity of the stacker guide 8 and this wall face 9*b* could be formed on the lift table 13 shown in FIG. 2.

As described above, in the banknote handling device according to the present invention, brake means comprising a projection such as to curve the side of a banknote moving through the slit and whereby the radius of curvature of this curved part is increased as the banknote moves downstream of the slit is provided, so the brake force acting on the tip of the banknote as it is being carried diminishes as the banknote is carried further downstream of the slit. Consequently, an abrupt increase of brake force acting on the banknote as a whole, in particular when the banknote is of long length, can be suppressed and the banknote guided in stable fashion downstream of the slit. Also, since the projection that exerts the brake action is arranged on the side of the stacker guide, no relative positional offset of the projection and the slit can occur so a stable brake force is always applied to the banknote and the banknote is reliably stopped in a fixed position of the stacker guide. Consequently, a banknote handling device can be provided in which banknotes of a plurality of types of different length can be accommodated in stable fashion in the same stacker and in which banknote jamming can be as far as possible prevented.

INDUSTRIAL APPLICABILITY

As described above, the present invention is adapted to a banknote handling device whereby a banknote can be reliably stopped in a fixed position of a stacker guide by always applying a stable brake force to the banknote, thereby preventing banknote jamming as far as possible and in which banknotes of a plurality of types of different length can thus be accommodated in stable fashion in the same stacker.

What is claimed is:

1. A banknote handling device that identifies the authenticity of inserted banknotes of a plurality of types of different length, guides inserted banknotes of a plurality of types of different length that are considered to be genuine into a slit of a stacker guide, and then accommodates the banknotes in the same stacker, characterized in that brake means is provided comprising a projection whereby a side of the banknote carried in the slit is curved and radius of curvature of the curved portion is caused to increase as the banknote is carried toward a downstream side of the slit.

2. The banknote handling device according to claim 1, characterized in that a recess is formed in one guide face of the slit, and the projection projects toward an interior of the recess of the slit and has a parallel face that is parallel with respect to a direction of advance of the slit, an inclined face that is inclined toward the parallel face and an inclined side face that is inclined so as to gradually depart from a wall face forming the recess toward a downstream side of the slit.

3. The banknote handling device according to claim 1, characterized in that a recess is formed in one guide face of the slit and the projection projects toward an interior of the recess of the slit and has an inclined face that is erected in a direction such as to depart from the recess with respect to a direction of advance of the slit and a side face that is parallel to a wall face forming the recess.

4. The banknote handling device according to claim 1, characterized in that the projection projects toward one guide face of the slit and has an inclined face that is erected in a direction such as to depart from the guide face with respect to a direction of advance of the slit and a wall face which is a wall face provided adjacent to and along the slit, in which a portion on the downstream side of an upper face of the wall face is formed as an inclined face that descends in a direction such as to depart from the inclined face with respect to the direction of advance of the slit.

5. The banknote handling device according to claim 1, characterized in that the projection is a wall face which is provided adjacent to and along the slit, and a portion in a downstream direction of an upper face of the wall face is formed as an inclined face descending in a direction such as to depart from the slit with respect to a direction of advance of the slit.

* * * * *